US006697494B1

(12) United States Patent
Klootsema et al.

(10) Patent No.: US 6,697,494 B1
(45) Date of Patent: Feb. 24, 2004

(54) METHOD TO GENERATE A PREDETERMINED OR PREDETERMINABLE RECEIVING CHARACTERISTIC OF A DIGITAL HEARING AID, AND A DIGITAL HEARING AID

(75) Inventors: Ronald Klootsema, St. Blaise (CH); Gerard van Oerle, Uster (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/461,951

(22) Filed: Dec. 15, 1999

(51) Int. Cl.[7] ..... H04R 25/00
(52) U.S. Cl. ..... 381/312; 381/91
(58) Field of Search ..... 381/91, 92, 122, 381/71.11, 312, 316, 317, 318, 321

(56) References Cited

U.S. PATENT DOCUMENTS 4,635,061 A 1/1987 Lepere et al.
5,400,409 A * 3/1995 Linhard ..... 381/92
5,825,898 A * 10/1998 Marash ..... 381/92
6,041,127 A * 3/2000 Elko ..... 381/92
6,178,248 B1 * 1/2001 Marash ..... 381/94.7

FOREIGN PATENT DOCUMENTS

DE 198 14 180 C1 3/1998
EP 0 419 9200 7/1992

* cited by examiner

*Primary Examiner*—Sinh Tran
(74) *Attorney, Agent, or Firm*—Pearne & Gordon LLP

(57) ABSTRACT

In order to generate a predetermined or predeterminable receiving characteristic of a digital hearing aid having at least two microphones, the analog output of at least one of the microphones (5*a*) is converted in an analog-digital manner by over-sampling and then is down-sampled. The time delay necessary to adjust the directional characteristics is carried out at the down-sampled signal. The two signals fed from the microphones (3*a*, 3*b*) to a superposition unit (11) are level matched.

8 Claims, 2 Drawing Sheets

| x | dB |
|---|---|
| −7 | −1.99 |
| −6 | −1.719 |
| −5 | −1.434 |
| −4 | −1.159 |
| −3 | −0.835 |
| −2 | −0.56 |
| −1 | −0.275 |
| 0 | 0 |
| 1 | 0.267 |
| 2 | 0.56 |
| 3 | 0.793 |
| 4 | 1.023 |
| 5 | 1.290 |
| 6 | 1.541 |
| 7 | 1.816 |

METHOD TO GENERATE A PREDETERMINED OR PREDETERMINABLE RECEIVING CHARACTERISTIC OF A DIGITAL HEARING AID, AND A DIGITAL HEARING AID

BACKGROUND OF THE INVENTION

The present invention relates to a method for generating a predetermined or predeterminable receiving characteristic of a digital hearing aid comprising at least two microphones, the outputs of which are subjected to analog-digital conversion and the digitized signals are superposed in additive manner after at least one of them has been subjected to a prescribed or adjustable time delay, the analog-digital conversion of the at least one time-delayed signal being implemented by oversampling.

The invention also relates to a digital hearing aid comprising at least two microphones, each followed by an analog-digital converter. At least one converter is operationally connected, by a delay device, to an additive superposition unit and at least the analog-digital converter acting through the delay device on the superposition unit is designed as an oversampling analog-digital converter.

The so-called "delay-and-add" method is known to generate predetermined or predeterminable receiving characteristics, particularly for digital hearing aids comprising at least two microphones.

Such a procedure is known from the German patent document 198 14 180, wherein the signal delay is implemented immediately after the sigma/delta conversion, i.e., the delay device immediately follows the sigma/delta converter. Oversampling takes place during sigma/delta conversion. Such a procedure offers the advantage that the time delay can be adjusted in fine steps.

SUMMARY OF THE INVENTION

An objective of the present invention is a procedure of the abovementioned sort wherein the time delay and signal matching can be optimally combined. In accordance with the present invention, following down-sampling, the oversampled converted digital signal is both time-delayed and level-matched. Alternatively, the delay device of the hearing aid is designed as a down-sampled filter element at which level-matching of the signals fed to the superposition unit also shall take place.

BRIEF DESCRIPTION OF THE DRAWINGS

These and further features of the invention will be apparent with reference to the following description and drawings, wherein:

As shown in FIG. 1, the hearing aid comprises two microphones 3*a* and 3*b* physically configured a predetermined space apart. The output signals from the microphones 3*a*, 3*b* each are converted into digital signals at the analog-digital converter 5*a* and 5*b* resp. Oversampling is carried out at least one of the cited analog-digital converters, illustratively as shown at the converter 5*a*. The output signal of the illustratively sigma/delta converter is down-sampled for instance as a one-bit flow of output data at a filter 7, series data words of illustratively 16 bits being generated. The time-delay $\tau$ corresponding to the delay-and-add directional method is set or adjusted at a unit 8 following said filter 7, where called for minimally in increments of incoming data words at correspondingly lower sampling frequency. At the same time and as schematically indicated by P, the level of the digital signal appearing at the output side can be matched, in the simplest manner possible, by shifting, subtracting/adding the data words formed at the filter 7. The digital signals which are guided at the output side of the second analog-digital converter 5 may, where called, for be made to pass through a second filter 9 and are present at the output side in the same data format as the digital data of the filter 7. The output signals of the filters 8 and 9 are superposed in known manner in a superposition unit 11 and where called for are made to pass through a filter 12 to enter the digital processing unit 13 of the hearing aid, said processing unit operating by its output on the electromagnetic output transducer of the hearing aid.

FIG. 2 shows the block diagram of the level matching unit 8 of FIG. 1, also, in tabular form, the level setting steps which can be attained in this manner.

Figure 1:
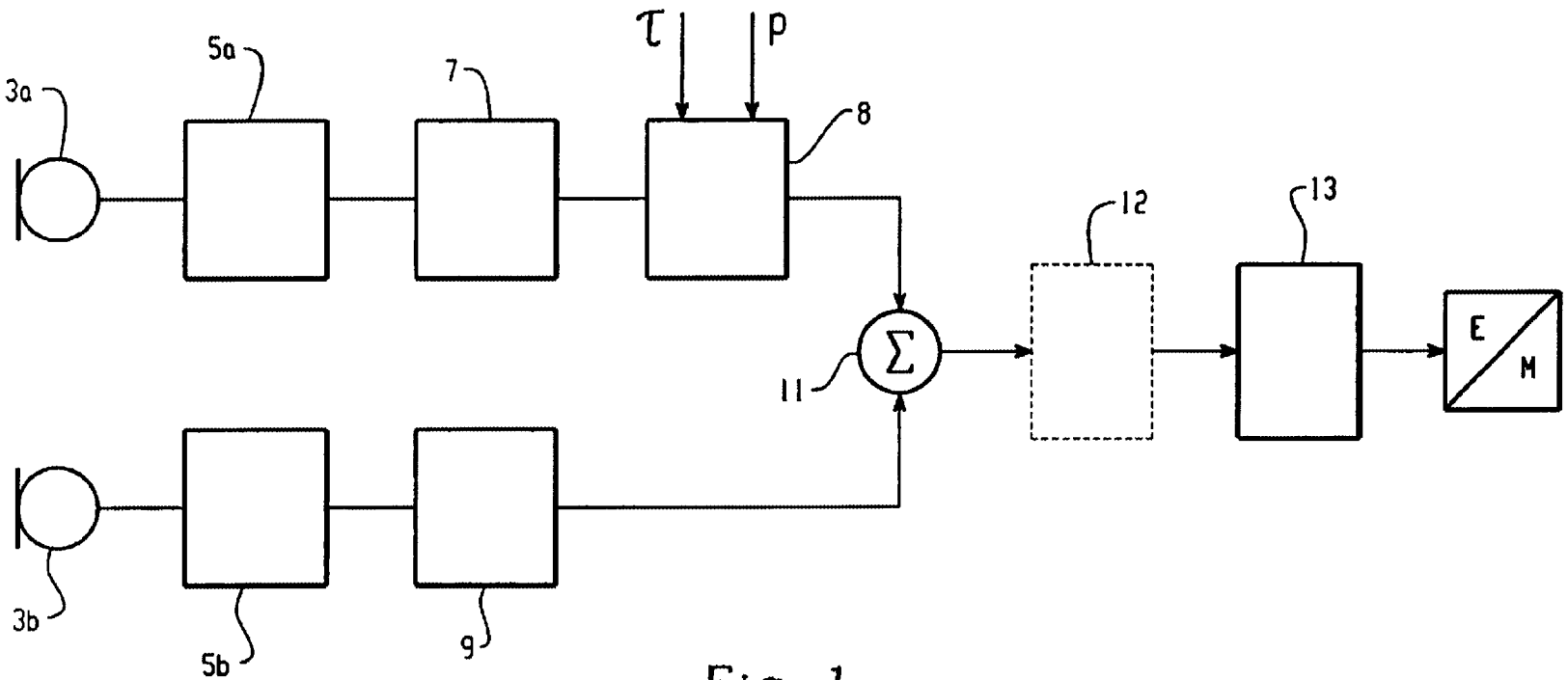
FIG. 1 shows a hearing aid of the invention in the form of a functional-block/signal-flow diagram.
Figure 2:
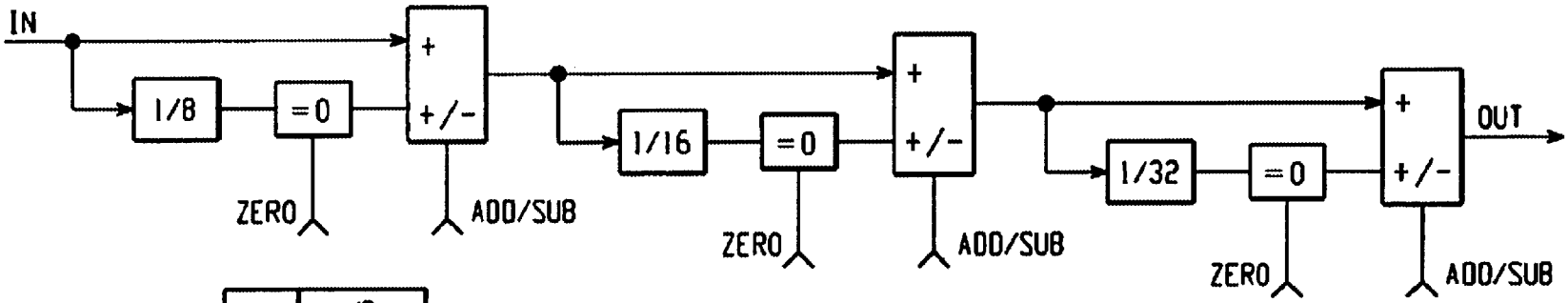
FIG. 2 shows a block diagram of the level-matching unit and the resultant stepwise level adjustments of the hearing aid of FIG. 1.

In principle both the time delay $\tau$ and the matching of the level P can be implemented using delay elements such as shift registers.

Because oversampling takes place at least at one of the analog-digital converters and immediately thereafter down-sampling is carried out, the invention offers the feasibility—resorting to the delay-and-add procedure—to integrate in exceedingly simple manner both a predetermined and a predeterminable time delay and to additionally provide level matching between the two superposed digital signals.

What is claimed is:

1. A method for generating a desired beamformer characteristic of a digital hearing aid device by the delay-and-add principle, comprising the steps of:

providing a first microphone arrangement;

providing a second microphone arrangement spaced by a predetermined distance from said first microphone arrangement;

generating a first analog electric signal with said first microphone arrangement;

generating a second analog electric signal with said second microphone arrangement;

equally treating said first and said second analog electric signals, including analog to digital conversion, oversampling, and downsampling, thereby generating a first series data word signal from said first analog electric signal and a second series data word signal from said second analog electric signal, said first and second data word signals having a common format;

mutually time delaying said first series data word signal by a predetermined number of increments of series data words;

level-matching said first series data word sigal with second series data word signal by data word shifting and adding/subtracting operations upon at least one of said first and second series data word signals; and adding said mutually time delayed and level-matched first and second series data word signals to generate an output signal with said desired beamformer characteristic.

2. The method of claim 1, further comprising the steps of:

performing at least one of said analog to digital converting of said first and said second signals by oversampling, thereby generating an over-sampled digital signal; and down-sampling said over-sampled digital signal for generating said respective series data word signal.

3. A digital hearing device comprising:

a first microphone arrangement with a first output;

a second microphone arrangement with a second output, said first and second outputs being equally operationally connected to respective analog to digital converters respectively generating first and second oversampled series data word signals at respective first and second outputs of said first and second analog to digital converters;

first and second downsampling units being respectively equally operationally connected to said first and second output of said first and second analog to digital converters for generating respective first and second downsampled series data word signals at respective first and second outputs of said first and second downsampling units;

a time delaying and signal level matching unit having an input operationally connected said first output of said first downsampling units; said time delaying and signal level matching unit including an output outputting a delayed series data word signal delayed by a number of data word increments and level-matched by data word shifting and data addition/subtraction;

an adding unit including an input operationally connected to said output of said time delaying and signal level matching unit and an input operationally connected to said second output of said second downsampling unit; said adding unit also including an output outputting an output signal having a desired beamformer characteristic.

4. The hearing aid of claim 3, wherein at least one of said analog to digital conversion units performs over-sampling, and further wherein a down sampling unit is interposed between said output of said at least one of said analog to digital conversion units and the input of the corresponding one of said time delaying and signal level matching unit and said adding unit.

5. A method for generating a desired characteristic of a digital hearing device by delay-and-add-principal comprising the steps of providing a first microphone;

providing a second microphone spaced by a predetermined distance from said first microphone so as to generate a mutual phase shift of acoustical signals impinging on said first and second microphones due to said predetermined distance;

generating a first electric signal with said first microphone;

generating a second electric signal with said second microphone;

analogue to digital converting said first electric signal to generate a first series data word signal;

analogue to digital converting said second electric signal to generate a second series data word signal;

providing a time delay between said first series data word and said second series data word, said time delay being selected as a function of said predetermined distance and according to said desired characteristic; and matching the levels of said mutually time delayed first series data word and adding said time delayed and level-matched first series data word signal and second series data word signal to result in a signal with the desired characteristic.

6. The method of claim 5, wherein the step of providing the time delay is performed by data word shifting.

7. The method of claim 5, wherein at least one of the steps of analog to digital converting is performed by oversampling and subsequent downsampling.

8. The method of claim 5, wherein the step of matching the levels is performed by an adding/subtracting operation.

* * * * *

UNITED STATES PATENT AND TRADEMARK OFFICE

CERTIFICATE OF CORRECTION

PATENT NO. : 6,697,494 B1
DATED : February 24, 2004
INVENTOR(S) : Ronald Klootsema et al.

It is certified that error appears in the above-identified patent and that said Letters Patent is hereby corrected as shown below:

Column 2,
Line 55, delete “sigal”, and insert therefor -- signal --.

Column 3,
Line 36, delete “down sampling”, and insert therefor -- down-sampling --.

Signed and Sealed this

Twentieth Day of July, 2004

JON W. DUDAS
*Acting Director of the United States Patent and Trademark Office*